US010184327B2

(12) United States Patent
Skyler

(10) Patent No.: US 10,184,327 B2
(45) Date of Patent: Jan. 22, 2019

(54) DOWNHOLE TOOL EXPLOSIVE WITH THERMALLY CONDUCTIVE MATERIAL

(71) Applicant: Schlumberger Technology Corporation, Sugar Land, TX (US)

(72) Inventor: David Skyler, Missouri City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/969,738

(22) Filed: Dec. 15, 2015

(65) Prior Publication Data

US 2017/0167234 A1 Jun. 15, 2017

(51) Int. Cl.

| | |
|---|---|
| ***C06B 45/00*** | (2006.01) |
| ***E21B 43/117*** | (2006.01) |
| ***F42B 1/028*** | (2006.01) |
| ***F42B 3/10*** | (2006.01) |
| ***F42B 33/02*** | (2006.01) |
| ***C06B 23/00*** | (2006.01) |
| ***C06C 7/00*** | (2006.01) |
| *D03D 23/00* | (2006.01) |
| *D03D 43/00* | (2006.01) |

(52) U.S. Cl.

CPC ..... *E21B 43/117* (2013.01); *C06B 23/001* (2013.01); *C06B 23/006* (2013.01); *C06C 7/00* (2013.01); *F42B 1/028* (2013.01); *F42B 3/10* (2013.01); *F42B 33/0207* (2013.01); *F42B 33/0285* (2013.01)

(58) Field of Classification Search

USPC ..... 149/22, 2, 108.2, 109.4

See application file for complete search history.

(56) References Cited

U.S. PATENT DOCUMENTS

| | | | | |
|---|---|---|---|---|
| 3,048,101 | A | 8/1962 | Lebourg | |
| 3,965,993 | A | 6/1976 | Lavigne et al. | |
| 4,671,177 | A | 6/1987 | Mayville | |
| 5,325,783 | A | 7/1994 | Wong | |
| 7,393,423 | B2 * | 7/2008 | Liu | C06B 33/00 149/108.2 |
| 2002/0129940 | A1 | 9/2002 | Yang et al. | |
| 2007/0047253 | A1 | 3/2007 | Lee et al. | |
| 2010/0307648 | A1 | 12/2010 | Marraud et al. | |
| 2012/0160492 | A1 | 6/2012 | Andrzejak et al. | |

FOREIGN PATENT DOCUMENTS

| | | | |
|---|---|---|---|
| CA | 2688696 | A1 | 6/2011 |
| FR | 2031677 | A5 | 11/1970 |

(Continued)

OTHER PUBLICATIONS

Fugallo et al. Nano letters 2014, 14, 6109-6114.*

(Continued)

*Primary Examiner* — James E McDonough

(57) ABSTRACT

A capsule can include a shell that defines at least a portion of a chamber; and a mixture of an explosive and a thermally conductive material disposed in the chamber. A method can include forming a mixture of an explosive and a thermally conductive material; disposing at least a portion of the mixture in a chamber of a capsule; and at least partially sealing the chamber.

7 Claims, 12 Drawing Sheets

(56) References Cited

FOREIGN PATENT DOCUMENTS

| | | | | |
|---|---|---|---|---|
| GB | 1451441 A | | 10/1976 | |
| WO | WO-2006092637 A2 | * | 9/2006 | ..... F42B 1/028 |

OTHER PUBLICATIONS

Zecheru et al., Synthesis and Applications of 3-nitro-1,2,4-triazol-5-one based Hybrid Energetic Compositions, Rev. Chim. (Bucharest), 65, No. 10, 2014.
Li et al., Preparation and Characterization of Insensitive HMX/Graphene Oxide Composites, Propellants Explos. Pyrotech. 2013, 38, 798-804.
Schlumberger, PowerJet Nova, Brochure 2014.
Kawaguchi et al., Intercalation Chemistry and Electronic Structure of Graphite-Like Layered Material BC2N, Journal of The Electrochemical Society, 157 (3) P13-P17 (2010).
Maienschein et al., Understanding and Predicting the Thermal Explosion Violence of HMX-Based and RDX-Based Explosives—Experimental Measurements of Material Properties and Reaction Violence, UCRL-JC-144615, 12th International Detonation Symposium, San Diego, California, 2002. Office of Naval Research.
Baytos, Specific Heat and Thermal Conductivity of Explosives, Mixtures, and Plastic-Bonded Explosives Determined Experimentally, Los Alamos Scientific Laboratory, LA-8034-MS, 1979.
Smithson, Detonation for Delivery, Oilfield Review, Spring 2012: 24, No. 1, pp. 55-56.
Glascoe et al., Pressure Dependent Decomposition Kinetics of the Energetic Material HMX up to 3.6 GPa, LLNL-JRNL-413499, Jun. 1, 2009, Journal of Physical Chemistry A.
Schlumberger, 3.67-in HSD High Shot Density Perforating Gun System, Brochure, 2014.
Chang et al., Thermal conductivity of B-C-N and BN nanotubes, J. Vac. Sci. Technol. B 23(5), Sep./Oct. 2005, pp. 1883-1886.
Schlumberger, 2¼-in HSD High Shot Density Perforating Gun System, 2014.
Baxter et al., Perforating—When Failure Is the Objective, Oilfield Review, Autumn 2009: 21, No. 3.
The extended european search report issued in the related EP Application 16200389.1, dated May 22, 2017 (8 pages).

* cited by examiner

DOWNHOLE TOOL EXPLOSIVE WITH THERMALLY CONDUCTIVE MATERIAL

BACKGROUND

A downhole perforating gun can be an example of a downhole tool and can include an explosive that can be discharged to generate one or more openings in a downhole structure and, for example, a surrounding geologic environment. As an example, such one or more openings may be utilized for fluid flow. For example, liquid and/or gas in a reservoir may flow via such one or more openings. As an example, fluid may be injected into a geologic environment via such one or more openings.

SUMMARY

A capsule can include a shell that defines at least a portion of a chamber; and a mixture of an explosive and a thermally conductive material disposed in the chamber. A method can include forming a mixture of an explosive and a thermally conductive material; disposing at least a portion of the mixture in a chamber of a capsule; and at least partially sealing the chamber. A system can include a regulated dispenser that dispenses a thermally conductive material; a regulated dispenser that dispenses an explosive; a bin that holds a mixture of the explosive as dispensed and the thermally conductive material as dispensed; a sensor that senses a thermal property of the mixture; and a controller that controls at least one of the regulated dispensers based at least in part on the thermal property of the mixture. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

Figure 1:
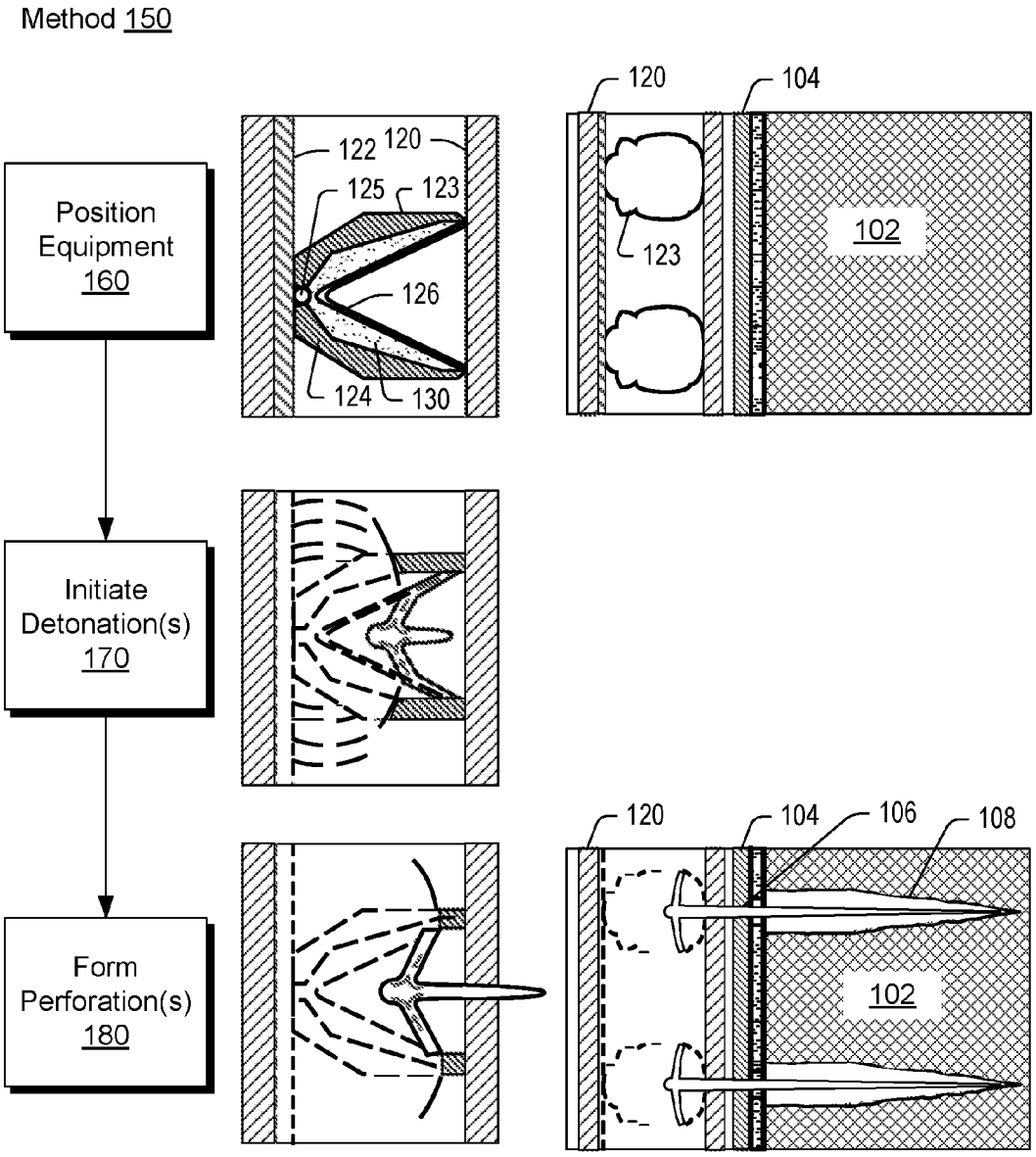
FIG. 1 illustrates an example of a method an examples of equipment including examples of equipment in a geologic environment.

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

As mentioned, a downhole perforating gun can include an explosive that can be discharged to generate one or more openings in a downhole structure and, for example, a surrounding geologic environment. As an example, such one or more openings may be utilized for fluid flow. For example, liquid and/or gas in a reservoir may flow via such one or more openings. As an example, fluid may be injected into a geologic environment via such one or more openings.

An explosive can include chemical explosive material having a high reaction rate that creates high combustion pressures. As an example, an explosive may be categorized as being a primary-high explosive or as a secondary-high explosive. A primary-high explosive can be sensitive, can be detonated easily and can be used in percussion and electrical detonators. A secondary-high explosive can be less sensitive, utilize a high-energy shock wave to achieve detonation and can be safer to handle. As an example, a secondary-high explosive can be used in elements of a ballistic chain (e.g., other than the detonator), such as in a detonating cord and/or one or more shaped charges.

As an example, a detonating cord can include an explosive sheathed in a flexible outer case, which can be used to connect a detonator to a main explosive. A detonating cord can provide a rapid initiation sequence that can be used to fire several charges simultaneously.

As an example, a shaped charge can include explosive and can be shaped and/or positioned to affect a certain direction preferentially. As an example, a shaped charge may be utilized to generate one or more openings (e.g., to perforate a well, etc.). As an example, a shaped charge may be utilized as an energy source for seismic acquisition (e.g., acquisition of seismic signals from a geologic environment as in seismology).

As an example, a perforating process can include using an explosive device that utilizes a cavity-effect explosive reaction to generate a high-pressure, high-velocity jet that creates a perforation tunnel. As an example, the shape of the explosive and powdered metal lining can determine the shape of the jet and performance characteristics of a charge. As an example, a high pressure and velocity jet can cause materials, such as steel, cement and rock formations, to flow plastically around a jet path, thereby creating a perforation tunnel. In such an example, openings may be made permanently in tubing such as, for example, a casing.

As an example, a perforating gun can be used in a perforating process. As an example, a perforating gun can include features for multiple shots. As an example, a perforating gun can be specified according to a number of shots per foot. For example, consider a perforating gun that includes more than about four shots per foot. As an example, a perforating gun can allow for phasing, distribution of perforations around a bore, etc.

FIG. 1 shows an example of a geologic environment 102 that includes an earthen bore (e.g., a bore defined by a rock wall) with a casing 104 disposed therein where a perforating gun 120 is disposed in a bore of the casing.

FIG. 1 also shows an example of a method 150 that includes a position block 160 for positioning equipment, an initiation block 170 for initiating one or more detonations and a formation block 180 for forming one or more perforations.

In the example of FIG. 1, the equipment can include the perforating gun 120, which can include a detonator cord 122, a shaped charge 123 that includes a shell 124, a primer igniter 125, a liner 126 and explosive 130.

Upon initiation, a detonation front can propagate within the perforating gun 120 as the explosive 130 reacts, forming a jet tip and a jet tail. As illustrated, the jet tip can be directed radially outwardly from the perforating gun 120. The jet tip can penetrate a wall of the perforating gun 120, if present, and can penetrate the casing 104 to form an opening 106 (e.g., a perforation) and can thereafter penetrate the geologic environment 102 to form a perforation 108. Where cement is present, the jet tip can also penetrate the cement, for example, after penetrating the casing 120 and before penetrating the geologic environment 102.

Figure 2:
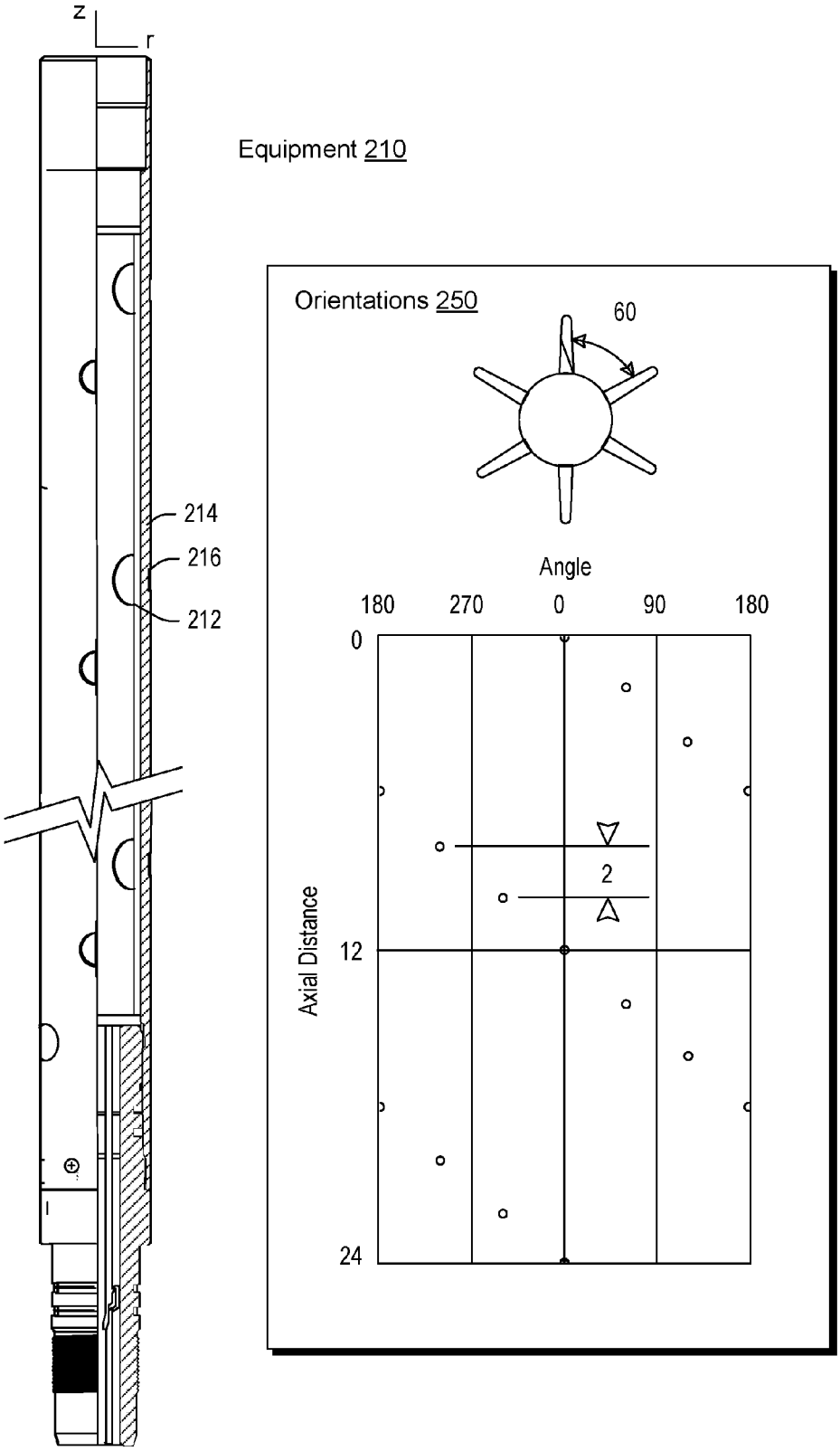
FIG. 2 illustrates an example of equipment that may be utilized in a downhole environment.

FIG. 2 shows an example of equipment 210 and various examples of orientations 250 of possible charges that may be set within the equipment 210. As an example, the equipment 210 may be a portion of a perforating system (e.g., a portion of a perforating gun, etc.). As an example, the equipment 210 can include a diameter of the order of inches (e.g., from about 1 inch or about 2.5 cm to about 10 inches or about 25 cm or more). Size and shape of a charge may be selected based at least in part on diameter of a piece of equipment such as a perforating gun. As shown in FIG. 2, the equipment 210 can include a longitudinal axis z from which radii may be measured (see, e.g., r).

As shown in the orientations 250, along an axial distance, the equipment 210 can include openings 212 for placement of explosive capsules and an outer shell 214 can include, for example, recesses 216 that thin the thickness of the outer shell 214 to facilitate perforation when an explosive capsule is detonated. As an example, the openings may be in a spiral or other type of pattern where the particular openings may be specified via an axial distance and an angle as well as, for example, a radius from the longitudinal axis and a radius or diameter of the opening (e.g., consider a projected diameter as the opening can be in a cylindrical surface).

As an example, a perforating gun can be a capsule gun or capsule-charge gun. As an example, a capsule can be an individual shaped charge sealed in a pressure-tight protective capsule. As an example, a series of capsules may be mounted on a carrier strip or links. As an example, a perforating gun may be utilized in a through-tubing perforation application. As an example, a perforating gun can be a hollow carrier gun. As an example, a hollow carrier gun can be a pressure-tight metal tube in which shaped charges are positioned.

As an example, a perforating gun can be operatively coupled to a wireline cable head, a tubing-conveyance assembly, etc. As an example, a perforating gun can include mating features such as, for example, threads, bayonets, etc. As an example, at a joint between components, fluid-sealing may be via one or more O-ring seals in a groove or grooves. As an example, one or more centralizers may be installed on an assembly.

Figure 3:
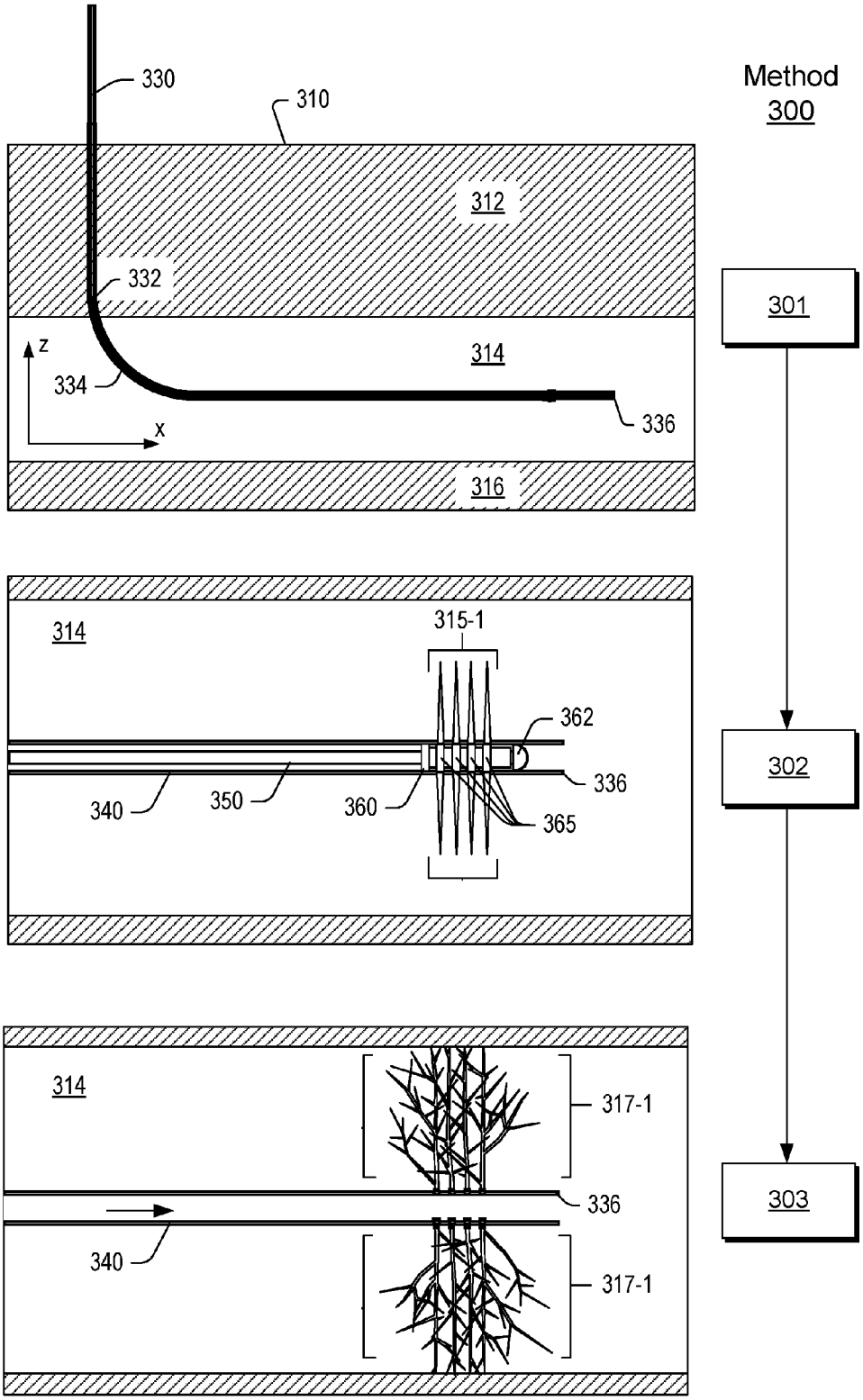
FIG. 3 illustrates an example of a method and examples of equipment for fracturing a geologic environment.

FIG. 3 shows an example of a method 300 that includes generating fractures. As shown, the method 300 can include various operational blocks such as one or more of the blocks 301, 302 and 303. The block 301 may be a drilling block that includes drilling into a formation 310 that includes layers 312, 314 and 316 to form a bore 330 with a kickoff 332 to a portion defined by a heel 334 and a toe 336, for example, within the layer 314.

As illustrated with respect to the block 302, the bore 330 may be at least partially cased with casing 340 into which a string or line 350 may be introduced that carries a perforating gun 360. As shown, the perforating gun 360 can include a distal end 362 and charge positions 365 associated with activatable charges that can perforate the casing 340 and form channels 315-1 in the layer 314.

Per the block 303, fluid may be introduced into the bore 330 between the heel 334 and the toe 336 where the fluid passes through the perforations in the casing 340 and into the channels 315-1. Where such fluid is under pressure, the pressure may be sufficient to fracture the layer 314, for example, to form fractures 317-1. In the block 303, the fractures 317-1 may be first stage fractures, for example, of a multistage fracturing operation.

Figure 4:
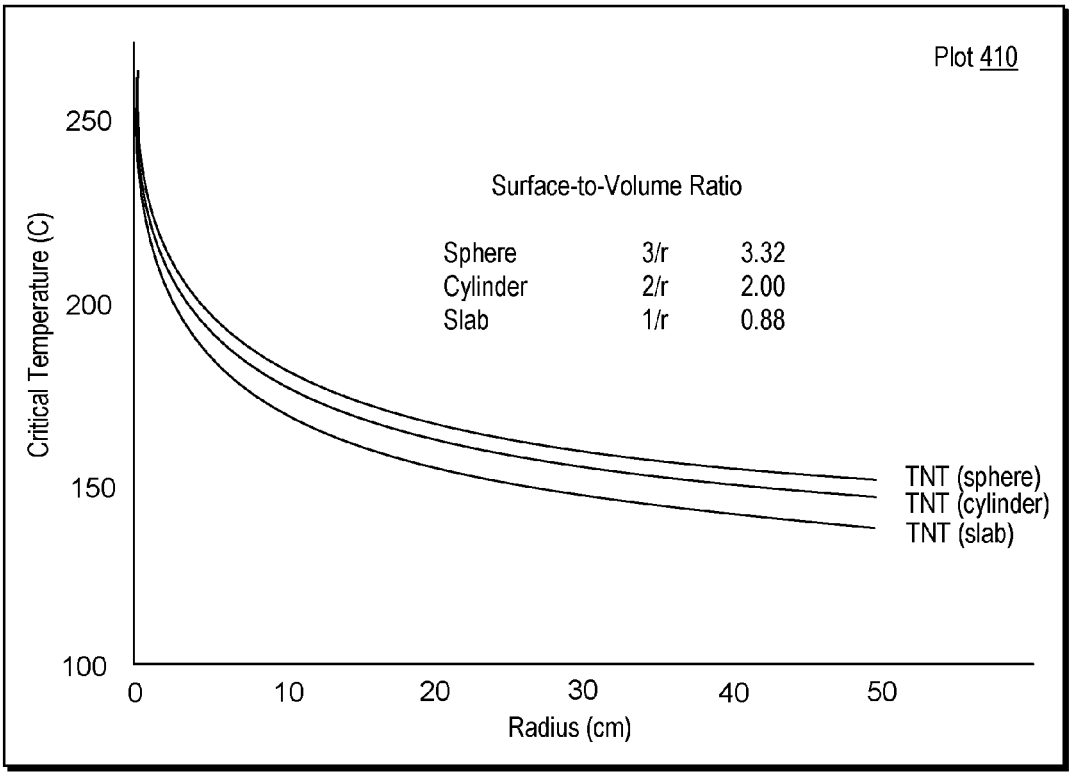
FIG. 4 illustrates examples of plots.
Figure 4:
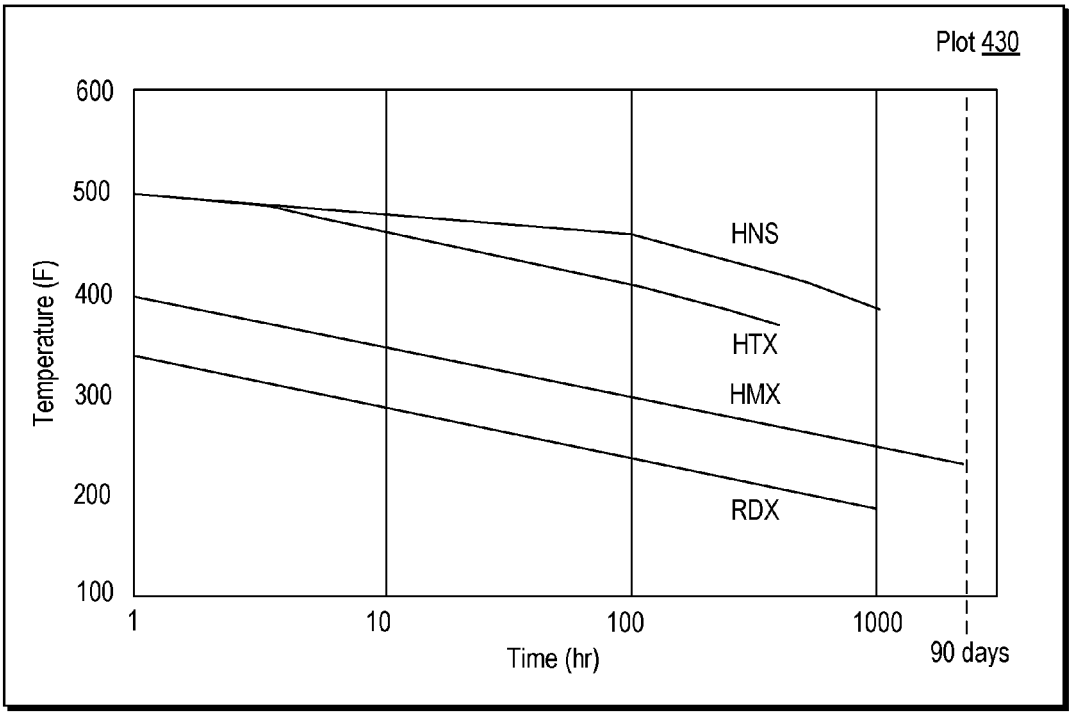

FIG. 4 shows an example plot 410 and an example plot 430 that include approximations as to trends in temperature and shape of explosive in the plot 410 and approximations as to temperature and time for different types of explosives in the plot 430.

The plot 410 shows approximate trends as to critical temperature in degrees C. for TNT versus shape and dimension, which is given as a radius in centimeters. The plot 410 shows the approximate trends for three shapes: sphere, cylinder and slab. As shown in the plot 410, the surface-to-volume ratio of a sphere is greater than that of a cylinder, which is greater than that of a slab. The critical temperature is the minimum temperature at which an explosive will self-heat catastrophically. Thus, for safety, a higher critical temperature is better than a lower critical temperature. As illustrated in the plot 410, a higher surface-to-volume ratio is one factor that can increase the critical temperature of an explosive. In other words, a volume of explosive may be "safer" when shaped as a sphere rather than as a cylinder because there is more surface area for heat transfer for the sphere (3.32 surface-to-volume ratio) than for the cylinder (2.0 surface-to-volume ratio).

The plot 430 of FIG. 4 shows temperature in degrees F. versus time in hours for 1,3,5-trinitroperhydro-1,3,5-triazine (RDX), octahydro-1,3,5,7-tetranitro-1,3,5,7-tetrazocine (HMX), High-Temperature eXplosive (HTX, Schlumberger Limited, Houston, Tex.) and 1,3,5-trinitro-2-[2-(2,4,6-trinitrophenyl)ethenyl]benzene (HNS). The plot 430 illustrates a general trend that an explosive may be stored (e.g., or otherwise exposed) for a longer period of time at lower temperature. As an example, an explosive (e.g., as a shaped charge) may be rated, for example, at 1 hour and at 100 hours with respect to temperature. For example, consider a rating of 1 hour at 400 degrees F. and a rating of 100 hours at 300 degrees F. A rating can be based at least in part on one or more of shape, surface-to-volume ratio, etc. As an example, for a given volume, a charge shaped as a sphere may have a higher temperature at 1 hour and a higher temperature at 100 hours than a charge shaped as a cylinder.

As an example, a capsule can include a shell that defines at least a portion of a chamber; and a mixture of an explosive and a thermally conductive material disposed in the chamber. In such an example, the thermally conductive material can increase heat dissipation and, for example, increase the critical temperature and/or, in such an example, the thermally conductive material can increase the temperature range or rating, for example, at 1 hour and at 100 hours.

In a perforating operation, the selection of a shaped charge explosive may be based at least in part on time-temperature specifications associated with at least a portion of the operation. For example, where time-temperature specifications indicate that a charge is to be exposed to a time-temperature profile that would allow for possible degradation of explosive, then one or more particular categories of explosives may be excluded and/or one or more particular categories of explosives may be included in a group from which a selection can be made. As an example, where time-temperature specifications cannot be met for use of nitramine or one or more other similarly high power explosives, these may be excluded from a selection group.

In the foregoing example as to selection of an explosive, the criteria involve at least temperature. As an example, a method can include adding one or more thermally conductive non-metallic materials into an explosive such that the resulting mixture is more thermally conductive. In such an example, thermal energy in the mixture may be more readily conducted and thereby diminished. For example, where a temperature differential may form in an explosive due at least in part to exothermic degradation of the explosive (i.e., prior to detonation), that temperature differential may be reduced through the presence of one or more thermally conductive non-metallic materials being mixed with the explosive.

As an example, where the exothermic degradation reaction follows an Arrhenius type of equation (e.g., where reaction rate increases with temperature), the presence of one or more thermally conductive non-metallic materials may act to further preserve the integrity of an explosive.

For convenience, an example of a form of the Arrhenius equation is presented below:

$$k=Ae^{-Ea/(RT)}$$

where k is the rate constant for a reaction, A is the pre-exponential factor, Ea is the activation energy, and R is the universal gas constant.

As an example, a nucleation and growth, global-kinetic-model based on the extended-Prout-Tompkins (e-PT) model may be utilized such as, for example:

$$dx/dt=(Ae^{-Ea/RT})(1-x)^n(1-q(1-x))^m$$

where x is the fraction reacted, Ea is the activation energy, R is the gas constant, T is temperature, A is the prefactor, n, m, and q are unitless variables associated with the reaction order, autocatalysis and nucleation, respectively.

As an example, a method can include extending lifetime of an explosive by incorporating one or more thermally conductive non-metallic materials into a mixture that includes the explosive where the one or more materials can dissipate heat caused by degradation within a single energetic crystal thereby diminishing autocatalytic decomposition of the explosive. Such a method can also enhance safety characteristics of the explosive.

In the examples of FIGS. 1 to 3, an explosive can be exposed to a temperature in excess of 100 degrees C. For example, a downhole environment may be at a temperature above about 250 degrees F. (e.g., above about 121 degrees C.). In such environments, an explosive may degrade (e.g., decompose).

An explosive may be subject to pressure-dependent kinetics as to thermal decomposition. For example, HMX (1,3,5,7-tetranitro-1,3,5,7-tetrazocane) exhibits pressure-dependent kinetics as to thermal decomposition. For example, pressure can accelerate HMX decomposition within one pressure range and can decelerate decomposition in another higher pressure range. Phases of HMX can also impact kinetics (e.g., δ versus β). As an example, where a chamber of a capsule is sealed, a pressure may be relatively constant in the chamber. Where a chamber includes a wall that can flex due to external pressure, pressure in a chamber may be affected by external pressure.

As an example, a method can include selecting one or more thermally conductive materials and amounts thereof based at least in part on temperature of an operational environment. As an example, a method can include selecting one or more thermally conductive materials and amounts thereof based at least in part on pressure of a sealed chamber (e.g., of a capsule). As an example, a method can include selecting one or more thermally conductive materials and amounts thereof based at least in part on one or more pressures where a capsule includes a wall that defines a chamber where the wall may flex with respect to an applied pressure.

As an example, an environment may be a harsh environment, for example, an environment that may be classified as being a high-pressure and high-temperature environment (HPHT). A so-called HPHT environment may include pressures up to about 138 MPa (e.g., about 20,000 psi) and temperatures up to about 205 degrees C. (e.g., about 400 degrees F. and about 480 K), a so-called ultra-HPHT environment may include pressures up to about 241 MPa (e.g., about 35,000 psi) and temperatures up to about 260 degrees C. (e.g., about 500 degrees F. and about 530 K) and a so-called HPHT-hc environment may include pressures greater than about 241 MPa (e.g., about 35,000 psi) and temperatures greater than about 260 degrees C. (e.g., about 500 degrees F. and about 530 K). As an example, an environment may be classified based in one of the aforementioned classes based on pressure or temperature alone. As an example, an environment may have its pressure and/or temperature elevated, for example, through use of equipment, techniques, etc. For example, a SAGD operation may elevate temperature of an environment (e.g., by 100 degrees C. or more; about 370 K or more).

As to HMX, decomposition can commence with either N—$NO_2$ bond homolysis or HONO formation; noting that one or more other initiation mechanisms may be present. The initial products of HMX decomposition can attack the starting material and intermediates, producing a variety of autocatalytic reactions. As mentioned, temperature can accelerate decomposition of HMX and, as mentioned, pressure can accelerate HMX decomposition.

As an example, a method can include forming a mixture of one or more thermally conductive non-metallic materials with an explosive. In such an example, where compatibility is maintained upon reducing oxide content, the magnitude of the effect on thermal stability may increase as oxide content decreases, which may increase the thermal conductivity of the filler.

As an example, a method can include forming a mixture of one or more thermally conductive non-metallic materials and an explosive to provide a heat dissipation mechanism for the explosive, which may act to reduce regions of heat build-up, magnitude of regions of heat build-up, etc.

As an example, where one or more thermally conductive non-metallic materials are included, they may provide for heat conduction that can be effective with regards to relatively slow processes of degradation and cookoff (e.g., processes that may be of the order of hours or days, depending on environmental temperature, etc.). Such one or more materials may be expected to have relatively minimal impact on shock induced initiation due to the short timescales of detonation.

As an example, a method can include providing an explosive and providing a thermally conductive material and tumbling the explosive and the thermally conductive material such that the thermally conductive material coats crystals of the explosive. In such an example, the thermally conductive material can be or include one or more of graphene, graphene oxide and carbon nanotubes. As an example, one or more other thermally conductive materials may be used.

As an example, a method can include incorporating a thermally conductive material via crystallization or crashing of an explosive in the presence of the thermally conductivity material.

As an example, HMX, RDX and other explosives can exhibit thermal instability arising from one or more sources. For example, there can be an intrinsic thermal stability associated with bond strengths of a single molecule of the explosive material; there can be one or more impurities, where, in the presence thereof, the explosive degrades more readily than it would without the one or more impurities; and there can be degradation of a single molecule of explosive can generate heat that causes a local temperature rise leading to increased degradation of adjacent explosive molecules. As to the latter, where a thermally conductive material is present, it may be able to (i) absorb some of the heat energy and (ii) conduct some of the heat energy away to a lower temperature region (e.g., within, at a surface, etc.).

As an example, as heat is generated by degradation of a single explosive material initiated thermally or otherwise the a thermal conductivity filler material can help to distribute that heat over an extended area, thereby diminishing localized temperature rises that can accelerate degradation. Such a mechanism may be implemented in a system where an explosive may be exposed to long term downhole degradation events and where there is sufficient time available for the redistribution of heat to occur.

Figure 5:
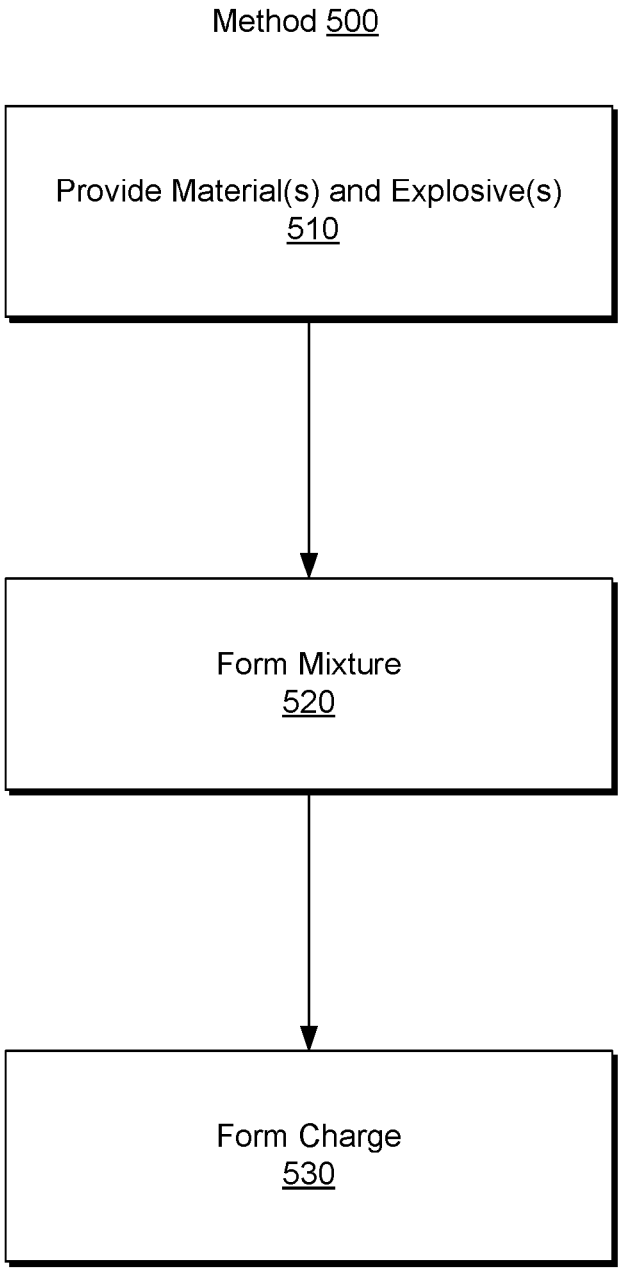
FIG. 5 illustrates an example of a method.

FIG. 5 shows an example of a method 500 that includes a provision block 510 for providing one or more materials and for providing one or more explosives, a formation block 520 for forming a mixture of the provided one or more materials and the provided one or more explosives, and a formation block 530 for forming a charge. In the example of FIG. 5, the charge may be suitable for use in a downhole environment. In such an example, the charge may be exposed to a temperature in excess of about 100 degrees C., for example, in excess of about 120 degrees C. (e.g., about 250 degrees F.).

As to such temperatures, consider that properties of an explosive may change (e.g., be temperature dependent).

Figure 6:
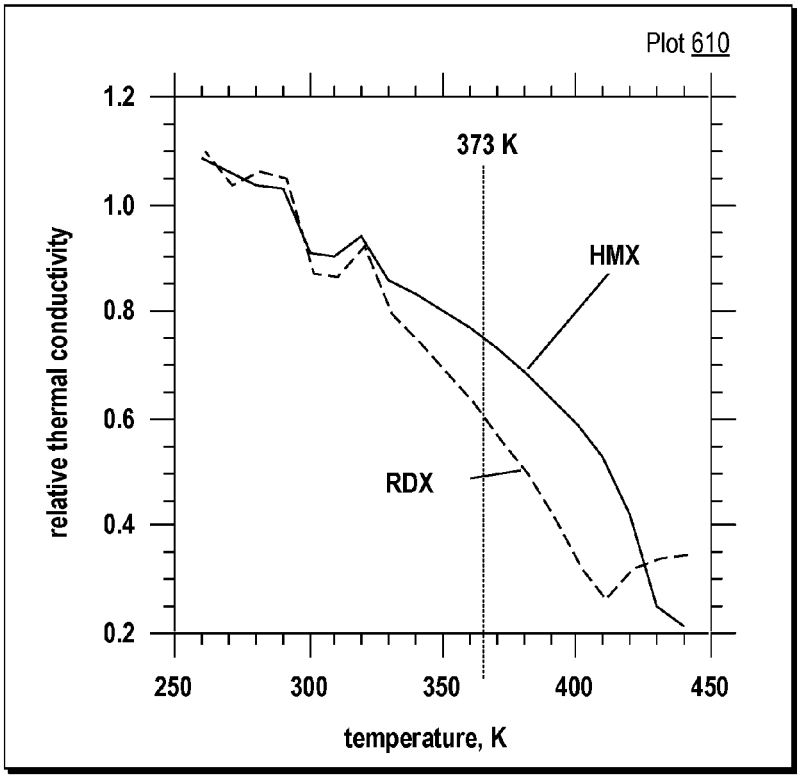
FIG. 6 illustrates example plots of data.
Figure 6:
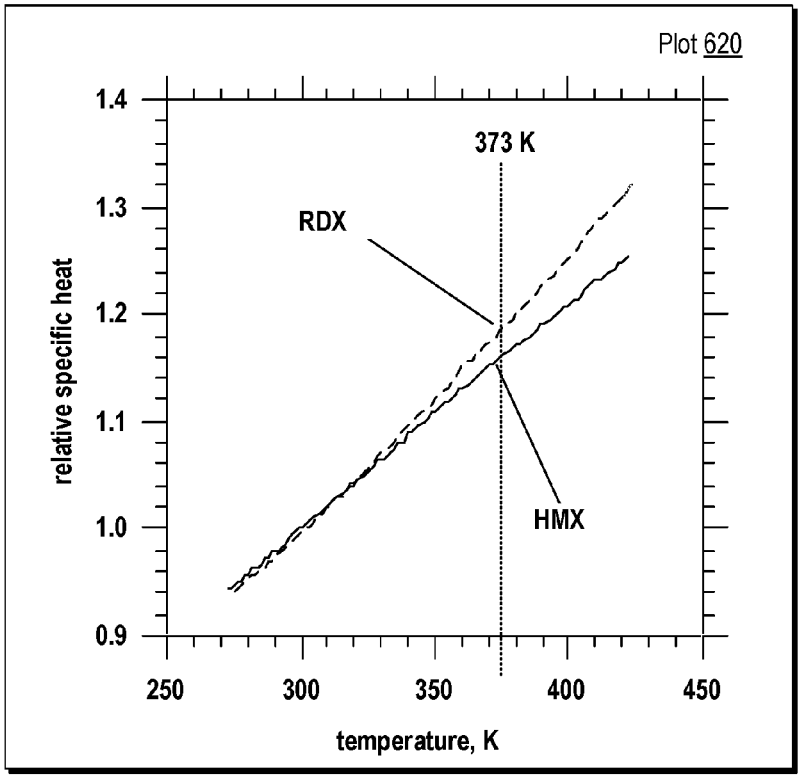

FIG. 6 shows example plots 610 and 620 of relative thermal conductivity and relative specific heat for HMX and RDX versus temperature. In the plot 510, thermal conductivity of pure HMX and RDX decreases by about 80 percent when heated to about 150 degrees C. above room temperature. Given such behavior, heat dissipation through thermal diffusion away from an initial location of thermal decomposition can be reduced. In the plot 520, specific heat for pure HMX and RDX at constant pressure increases by about 25 to about 30 percent over a similar temperature range, which indicates that the temperature increase is reduced for a given extent of reaction compared to that expected from room-temperature specific heat data. Given such behavior, reduced thermal conductivity may speed up the onset of self-heating to run-away while the increased specific heat may slow down the self-heating onset.

The data of the plots 610 and 620 demonstrate various factors that may be taken into account when selecting a thermally conductive material and determining an amount of the thermally conductive material to add to form a mixture.

As an example, a mixture may be formed for use in a downhole operation where downhole temperatures may exceed about 373 K (e.g., exceed about 100 degrees C. or about 212 degrees F.). Where such a mixture includes an explosive such as HMX or RDX, information such as that of the plots 610 and 620 may be utilized in determining an amount, a type, etc., of a thermally conductive material to be included in the mixture. As an example, one or more equations may be utilized such as, for example, the aforementioned Arrhenius equation, the aforementioned e-PT equation, etc. Such equations may be utilized with actual and/or estimated time and temperature information as well as, for example, information such as that of thermal conductivity of an explosive, specific heat of an explosive, etc. As an example, pressure information may be utilized in formulating a mixture.

As an example, the thermal conductivity of HMX in crystalline form at 373 K (e.g., about 100 degrees C. or about 212 degrees F.) may be about 0.4 $W \cdot m^{-1} \cdot K^{-1}$; noting a melting point of about 550 K (e.g., about 277 degrees C. or about 530 degrees F.). According to the plot 610, the decrease in thermal conductivity at about 450 K may be provide a value of about 25 percent of that at 373 K, for example, about 0.1 $W \cdot m^{-1} \cdot K^{-1}$.

As an example, a thermally conductive material can be or include graphene. As an example, a basal plane thermal conductivity of graphene may be about 1,000 $W \cdot m^{-1} \cdot K^{-1}$ or more (e.g., about 3,000 $W \cdot m^{-1} \cdot K^{-1}$ or more).

As an example, a thermally conductive material can be or include diamond. As an example, thermal conductivity of diamond may be about 900 $W \cdot m^{-1} \cdot K^{-1}$ or more (e.g., over about 1,000 $W \cdot m^{-1} \cdot K^{-1}$ or more). Diamond is a good conductor of heat because of the strong covalent bonding and low phonon scattering. As an example, monocrystalline synthetic diamond may be utilized, which can be enriched in the isotope 12C, for example, to provide a thermal conductivity at room temperature of about 3,320 $W \cdot m^{-1} \cdot K^{-1}$.

Figure 7:
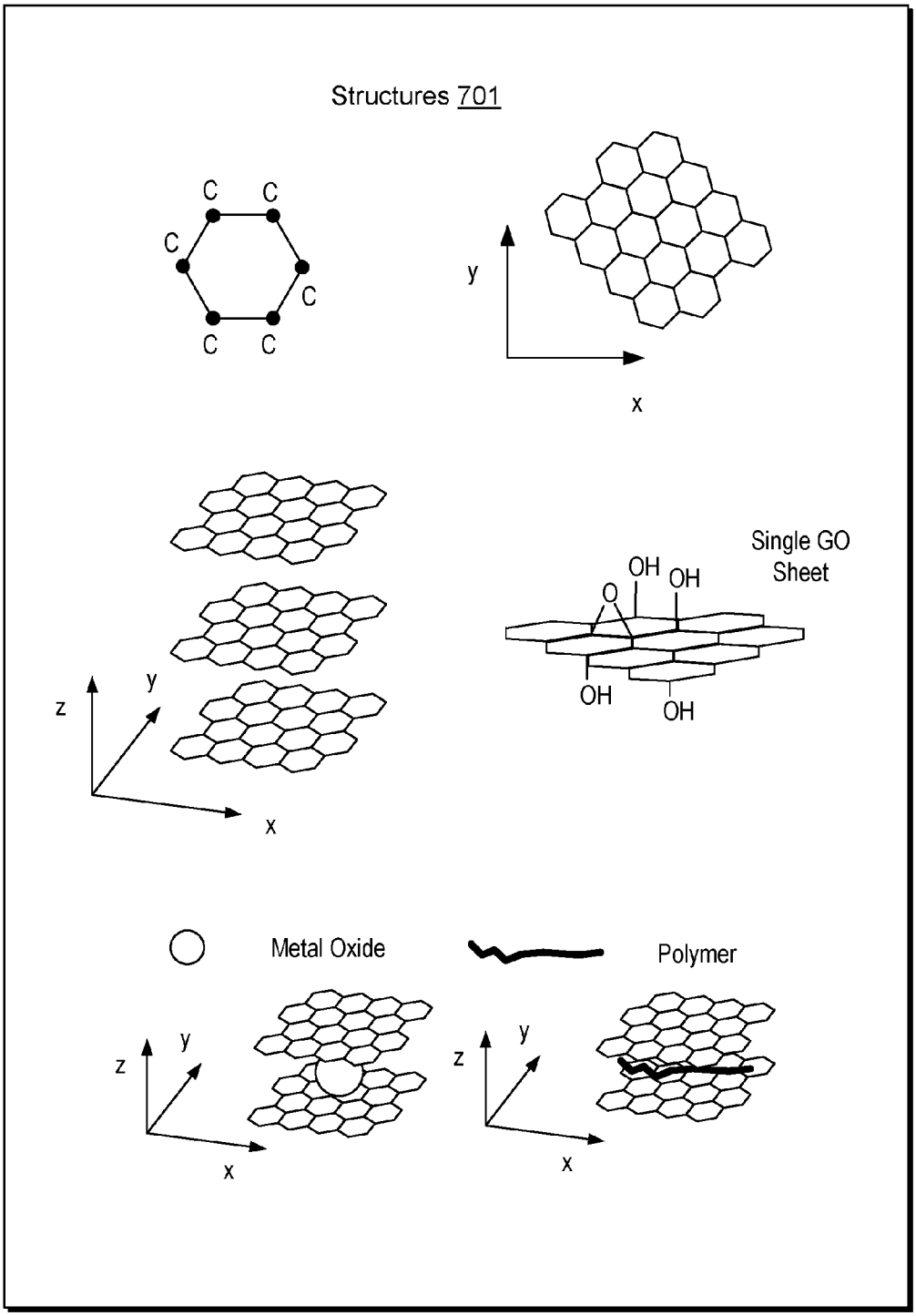
FIG. 7 illustrates examples of thermally conductive materials.

FIG. 7 shows examples of structures 701. In FIG. 7, the structures 701 include graphene where, for example, carbon atoms may be arranged in a hexagonal manner, due to $sp^2$ bonding, as a crystalline allotrope of carbon (e.g., as a large aromatic molecule). Graphene may be described as being a one-atom thick layer of graphite and may be a basic structural element of carbon allotropes such as, for example, graphite, charcoal, carbon nanotubes and fullerenes.

As illustrated the structures 701 may include a layer of graphene or layers of graphene, which may be described, for example, with respect to a Cartesian coordinate system (x, y, z). As an example, a layer may be bonded to another layer, for example, via interactions that may involve epoxide and hydroxyl groups. As an example, one or more layers may include one or more of epoxide, carbonyl (C═O), hydroxyl (—OH), and phenol groups, which may optionally participate in bond formation. For example, see an approximate representation of a single graphene sheet in the structures 701, which includes various oxygen groups (e.g., a GO sheet).

While graphite is a three-dimensional carbon-based material made of layers of graphene, graphite oxide differs. By oxidation of graphite using one or more oxidizing agents (e.g., sulfuric acid, sodium nitrate, potassium permanganate, etc.), oxygenated functionalities can be introduced in a graphite structure (e.g., hydroxyl, epoxide, etc.) that can expand layer separation and impart hydrophilicity. The imparted hydrophilicity can allow for exfoliation of graphite oxide in water (e.g., via sonication assist, etc.) to produce single or few layer graphene, which may be referred to as graphene oxide (GO); noting that one or more other techniques for exfoliation may be implemented, additionally or alternatively (e.g., other mechanical, chemical, thermal, etc.). Thus, a difference between graphite oxide and graphene oxide can be the number of layers. For example, a dispersion of graphene oxide may include structures of a few layers or less (e.g., flakes and monolayer flakes); whereas, structures of graphite oxide include more layers. As an example, graphene oxide (GO) may be reduced to form reduced graphene oxide (rGO). As an example, graphene oxide may include surface charge, which may be negative (e.g., consider presence of oxygen), depend on factors such as pH, etc.

As an example, a material may include graphene. As an example, a material may include graphene and a metal oxide bound via hydrogen bonds to the graphene. As an example, a material may include graphene and one or more polymers that may be capable of forming hydrogen bonds and/or other bonds to the graphene. As an example, a material may include graphene, oxide(s) and one or more polymers.

As illustrated, the structures 701 may include a layer of graphene or layers of graphene, which may be described, for example, with respect to a Cartesian coordinate system (x, y, z). As an example, a layer may be bonded to another layer, for example, via interactions that may involve epoxide and hydroxyl groups. As an example, one or more layers may include one or more of epoxide, carbonyl (C═O), hydroxyl (—OH), and phenol groups, which may optionally participate in bond formation. For example, see an approximate representation of a single graphene sheet in the structures 701, which includes various oxygen groups (e.g., a GO sheet).

As an example, layers of graphene may be bonded via one or more metal oxides and hydrogen, for example, magnesium oxide may bind to graphene via hydrogen atoms; and/or layers of graphene may be bonded via one or more polymers and hydrogen (e.g., and/or other group).

As an example, a material may exhibit one or more regions that deviate from planarity (e.g., a buckling like structure). As an example, a material may include disorder and/or irregular packing of layers.

As an example, a thermally conductive material may be or include boron nitride. For example, consider hexagonal boron nitride, which may be referred to as h-BN, α-BN, or g-BN (graphitic BN). Hexagonal boron nitride (point group=$D_{6h}$; space group=$P6_3/mmc$) has a layered structure. Within each layer, boron and nitrogen atoms are bound by strong covalent bonds, whereas the layers are held together by weak van der Waals forces. The interlayer registry of these sheets differs, however, from the pattern seen for graphite, because the atoms are eclipsed, with boron atoms lying over and above nitrogen atoms. This registry reflects the polarity of the B—N bonds.

Thermal conductivity of suspended few-layer hexagonal boron nitride (h-BN) measured for thermal resistance values of about 11 to about 12 atomic layer h-BN samples with suspended lengths ranging between about 3 and about 7.5 microns, provided a room-temperature thermal conductivity of an 11-layer sample at about 360 $W \cdot m^{-1} \cdot K^{-1}$, approaching the basal plane value reported for bulk h-BN. As an example, h-BN can have a thermal conductivity in excess of about 360 $W \cdot m^{-1} \cdot K^{-1}$ in the basal plane (e.g., about 600 $W \cdot m^{-1} \cdot K^{-1}$).

As an example, a thermally conductive material may be asymmetric in its thermal conductivity. For example, basal plane values of a material may differ from a direction that is perpendicular to a basal plane. In such an example, the material may be included in a mixture as orientations can be available in the mixture with respect to an explosive (e.g., crystalline in form, etc.) to transport heat energy via conduction. In such an example, conduction can help to reduce regions of heat build-up that may be generated via decomposition of the explosive.

As an example, a thermally conductive material can include the cubic form of boron nitride, which has the sphalerite crystal structure and may be referred to asp-BN or c-BN. As an example, c-BN can have a thermal conductivity in excess of about 100 $W \cdot m^{-1} \cdot K^{-1}$, for example, about 700 $W \cdot m^{-1} \cdot K^{-1}$.

As an example, B—C—N nanotubes may be utilized as a thermally conductive material. As an example, BN nanotubes may be utilized as a thermally conductive material; noting that at room temperature, the thermal conductivity of a multi-walled BN nanotube is within about 0.04 to about 0.32 times that of a multi-walled carbon nanotube. As an example, carbon nanotubes may be utilized as a thermally conductive material.

As an example, a thermally conductive material can be or include one or more $BC_6N$ hybrids, for example, where carbon substitutes for some B and N atoms. As an example, consider a material such as $BC_xN_y$ where x=2.0-2.4, y=0.8-0.9, which may be referred to generally as $BC_2N$. As an example, a thermally conductive material can include boron, carbon and nitrogen.

As an example, a thermally conductive material can be or include boron arsenide (BAs). As an example, BAs may be included as cubic boron arsenide. As an example, cubic BAs can have a relatively high thermal conductivity. For example, consider a room temperature thermal conductivity that is about 2,000 $W \cdot m^{-1} \cdot K^{-1}$ or more.

As an example, a thermally conductive material may be or include one or more metalloids. For example, boron is a metalloid, which is not a metal, and, for example, arsenic is a metalloid, which is not a metal. As an example, the following may be considered to be metalloids: B, Si, Ge, As, Sb and Te.

As an example, a charge can include about 3 grams to about 150 grams or more of explosive. As an example, a booster can include about 0.5 grams or more of explosive.

Figure 8:
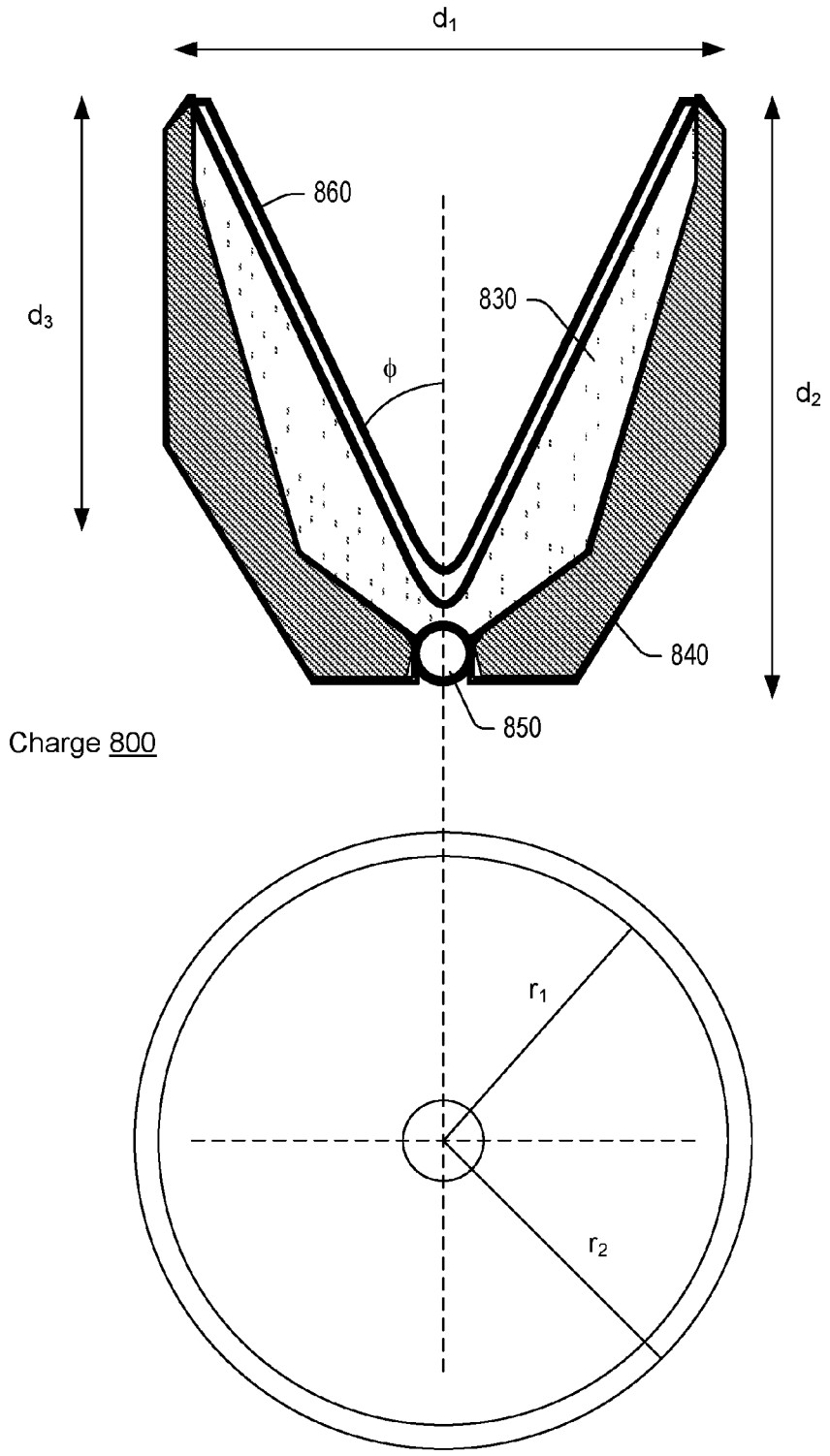
FIG. 8 illustrates an example of a shaped charge.

FIG. 8 shows an example of a shaped charge 800 that includes explosive 830 disposed in a chamber formed at least in part by a shell 840 and a liner 860. As shown, the shaped charge 800 may include a primer igniter 850.

As an example, the shell 840 may be made of a material such as, for example, steel. As an example, the liner 860 may be made of a material such as, for example, a material that includes tungsten. As an example, the liner 860 may be made of a pressed material (e.g., compacted metal or alloy powder, etc.).

As shown in FIG. 8, the shell 840 includes an inner surface and an outer surface where the inner surface defines a portion of a chamber for the explosive 830. As shown in FIG. 8, the liner 860 includes an inner surface and an outer surface where the inner surface defines a portion of the chamber for the explosive 830. Various dimensions are shown in the example of FIG. 8, which can include dimensions $d_1$, $d_2$, and $d_3$ and, for example, radii $r_1$ and $r_2$ and an angle $\phi$ (e.g., cone angle, etc.).

As an example, a chamber of a shaped charge can be characterized by a volume. As an example, the volume may hold a mass of an explosive or a mass of a mixture that includes an explosive and that includes one or more thermally conductive materials. As an example, a chamber may be sealed at a particular pressure. As an example, a sealed chamber may be formed by walls that are relatively rigid such that pressure in an operational environment does not substantially affect a chamber pressure of the sealed chamber.

As an example, where the shaped charge 800 of FIG. 8 is about several centimeters in diameter and about several centimeters in height, a chamber may be formed that is of the order of about several cubic centimeters or more. For example, consider a volume of about 5 cubic centimeters.

As an example, HMX can have a density of about 1.91 g/cm$^3$ in crystalline form. As an example, a packed form of HMX may have a density that is a fraction of the crystalline form density. For example, consider a packed density that is about 0.7 to about 0.99 the density of the crystalline form.

As an example, for the aforementioned shaped charge dimensions, a chamber may be about 5 cubic centimeters and a mass of explosive may be about 10 grams. In such an example, a mass of thermally conductive material may be included with the explosive as a mixture. For example, particles of thermally conductive material may be mixed in with crystals of the explosive.

As an example, a coated explosive may be included in a chamber where crystals of explosive are at least partially coated with a thermally conductive material to form a mixture (e.g., a mixture of an explosive and the thermally conductive material).

As mentioned, thermally conductive material can be non-metallic. For example, thermally conductive material can be non-metallic and formed predominantly from carbon. For example, consider diamond and graphene.

As an example, in terms of mass percentage of a mixture that includes at least one explosive and at least one thermally conductive non-metallic material, the at least one thermally conductive non-metallic material may be present at a percentage that is within a range from about 0.1 percent by mass to about 10 percent by mass. As an example, a range may be from about 0.1 percent by mass to about 5 percent by mass.

As an example, a range may be from greater than about 5 percent by mass depending on geometry of a chamber of a shaped charge into which a packed mixture is disposed and one or more of temperature, time and pressure to which the shaped charge may be exposed. For example, consider a mixture of about 94 percent by mass HMX and about 6 percent by mass of a carbon-based thermally conductive material (e.g., graphene, diamond, etc.).

Figure 9:
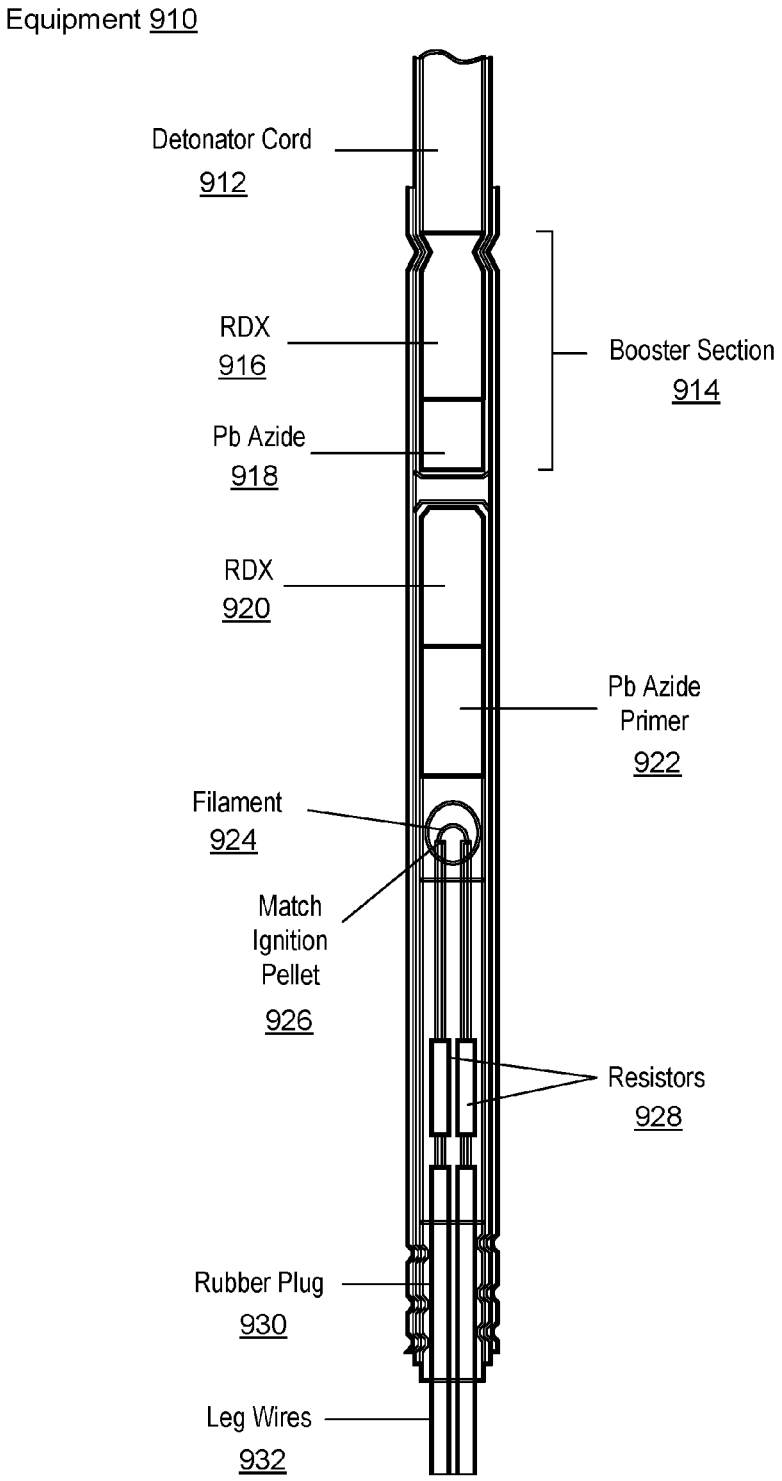
FIG. 9 illustrates an example of equipment that may be utilized in a downhole environment.

FIG. 9 shows an example of equipment 910 that is configured with components for electrical detonation. As shown, the equipment 910 includes a detonator cord 912, a booster section 914 with a first explosive 916 and a second explosive 918, another section with more of the first explosive 920 and more of the second explosive 922, a filament 924, a match ignition pellet 926, resistors 928, a rubber plug 930 and leg wires 932.

In the example of FIG. 9, current may be provided via the leg wires 932 to heat the filament 924, which can cause the pellet 926 to ignite and commence a chain reaction as lead azide and RDX in the primer and booster sections set off the detonator cord. In such an example, lead azide can be employed as a primary explosive whereas RDX can be employed as a type of secondary explosive.

As an example, one or more chambers of the equipment 910 can include at least one explosive and at least one thermally conductive material, which can be a non-metallic thermally conductive material.

Figure 10:
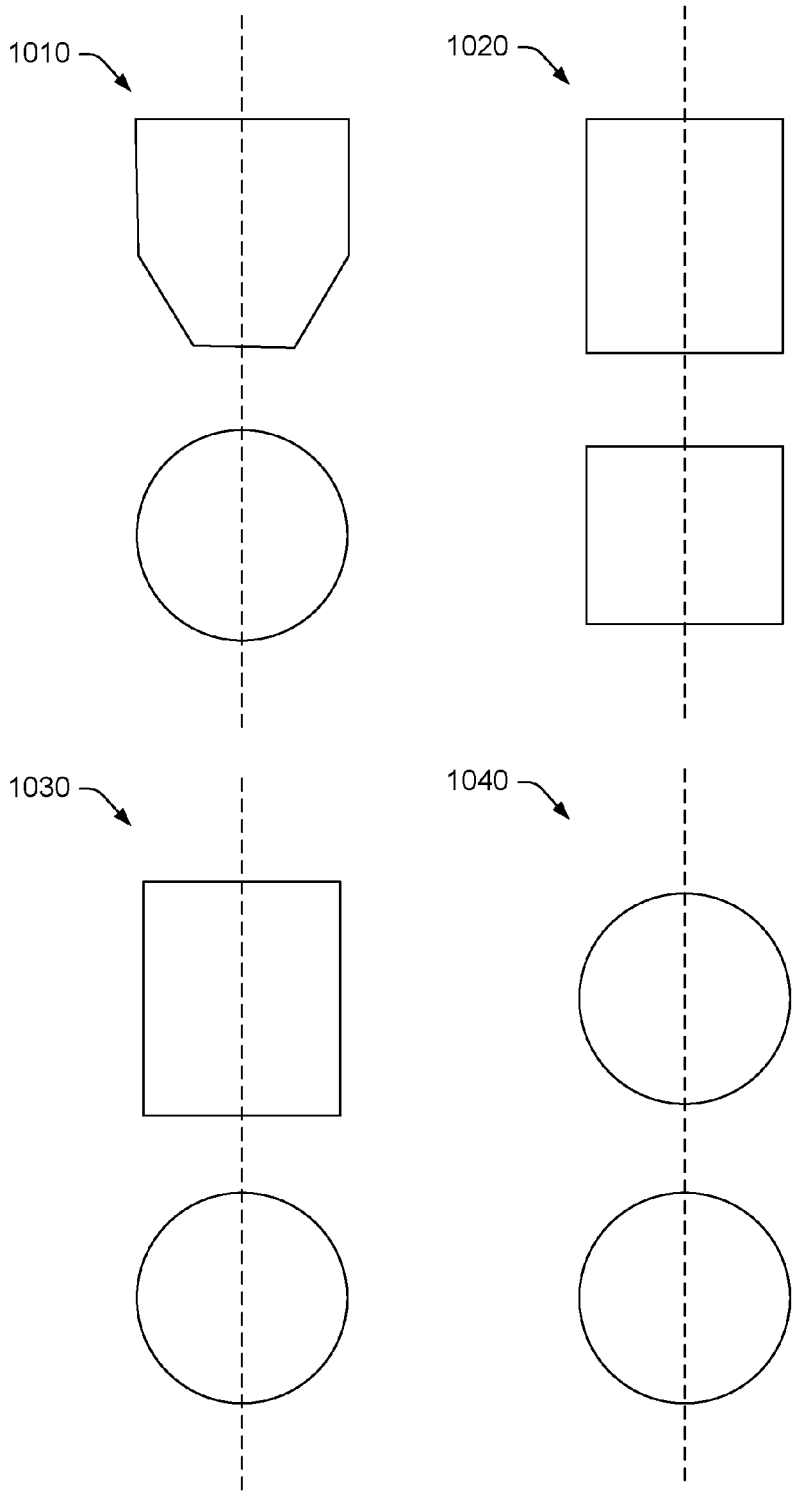
FIG. 10 illustrates examples of capsules.

FIG. 10 shows some examples of approximate shapes of capsules, which may be shapes of a shaped charge, a shaped booster or other type of shaped explosive capsule. The examples of FIG. 10 include a capsule with cylindrical shape with a taper 1010, a capsule with a cuboid shape 1020, a capsule with a cylindrical shape 1030 and a capsule with a spherical shape 1040.

As an example, each of the capsules 1010, 1020, 1030 and 1040 can include at least one chamber that includes a mixture of at least one explosive and at least one thermally conductive material, which may be non-metallic. As an example, a chamber can include a packed mixture with a density that is greater than about 1.5 g/cm$^3$. As an example, a chamber may have a volume of about 0.25 cm$^3$ or more (e.g., as a booster chamber). As an example, a chamber may have a volume of about 1 cm$^3$ or more. As an example, a chamber can have a volume of the order of several cubic centimeters or more and can include a packed mixture that has a mass of about 3 grams or more. Such a chamber may be a chamber of a shaped charge that can be utilized with downhole equipment such as, for example, a perforating gun and/or a detonator that includes a booster section to activate a detonator cord.

As an example, a method can include measuring thermal effusivity, for example, of a thermally conductive additive, of an explosive, of a mixture of thermally conductive additives, of a mixture of an explosive and one or more thermally conductive additives, etc.

In thermodynamics, the thermal effusivity of a material can be defined as the square root of the product of a material's thermal conductivity and its volumetric heat capacity. For example, consider the following equation:

$$e=(k\rho c_p)^{1/2}$$

In the foregoing equation, k is the thermal conductivity, ρ is the density and $c_p$ is the specific heat capacity. The product of ρ and $c_p$ can be referred to as the volumetric heat capacity.

As an example, a system can include one or more sensors. As an example, a sensor package can include circuitry to measure one or more of thermal conductivity, thermal effusivity and thermal diffusivity.

As an example, a sensor can include circuitry that supplies heat via a filament and uses the filament to measure heat reflected back by a sample. Such an approach may be implemented via access to one side of a sample. A measurement may be acquired in a time frame (e.g., of the order of seconds) that allows for online measurement in a manufacturing process. As an example, a sensor may be part of a sensor system marketed by C-Therm Technologies Ltd. (Fredericton, New Brunswick, Canada). For example, consider one or more sensor systems that provide thermal analysis of one or more the following material properties: thermal conductivity, thermal effusivity and thermal inertia. As an example, a system may provide information germane to one or more of consistency, homogeneity, abnormalities, etc.

Figure 11:
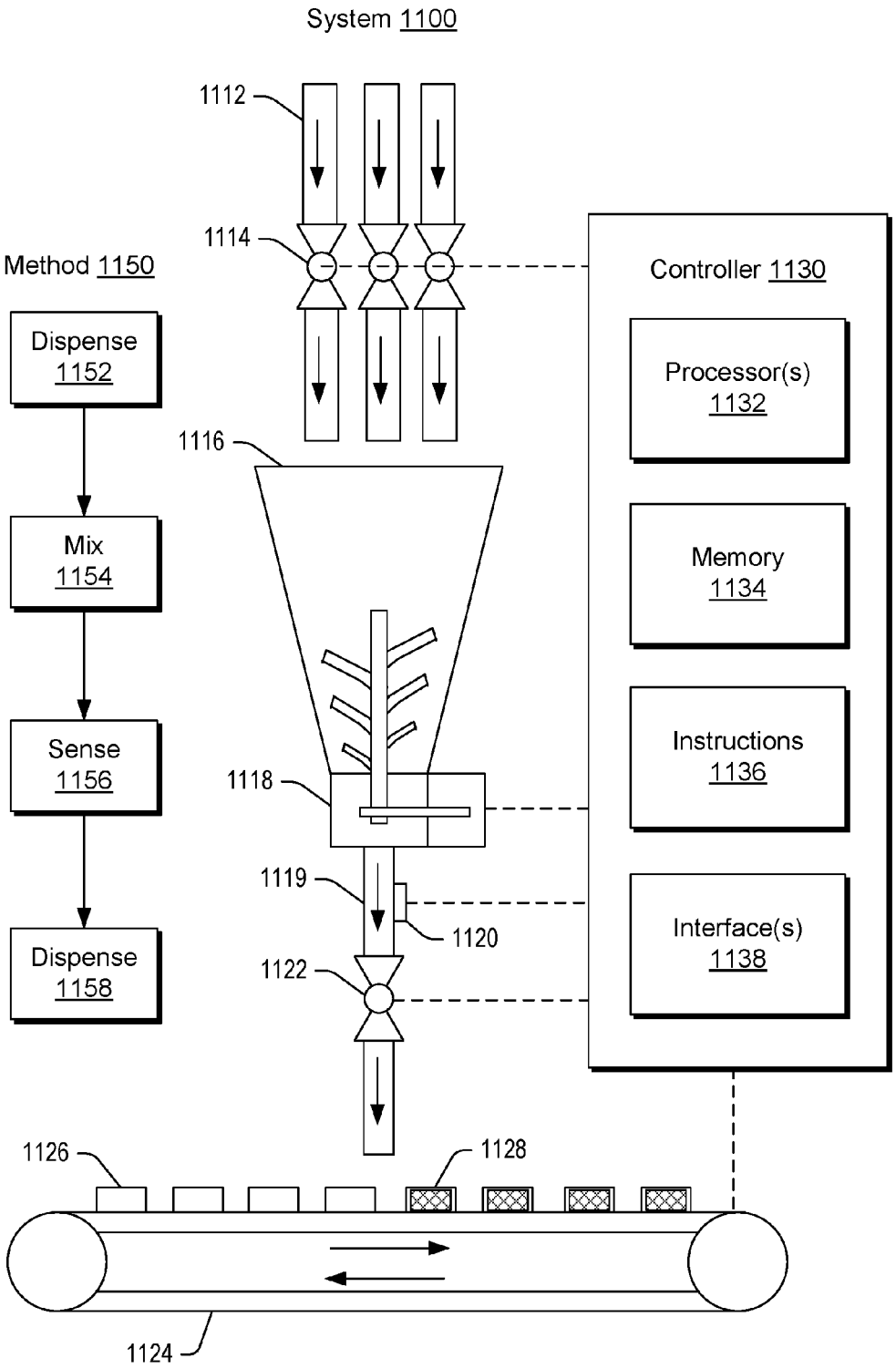
FIG. 11 illustrates an example of a system and an example of a method.

FIG. 11 shows an example of a system 1100 and an example of a method 1150. The system 1100 is illustrated via approximate pieces of equipment as various other types of equipment may be utilized to formulate a mixture and/or to dispense a mixture into capsule chambers, etc.

As shown in the example of FIG. 11, the system 1100 includes feed lines 1112 that may be regulated, for example, via valves 1114. As shown, the feed lines 1112 can dispense materials into a bin 1116 that can include a mixer 1118 (e.g., one or more blades, etc.). The bin 1116 can include a dispensing outlet 1119 that may be fit with a sensor 1120 and, for example, a regulator such as, for example, a valve 1122. In the example of FIG. 11, the feed lines 1112 and valves 1114 can be regulated dispensers. In the example of FIG. 11, the dispensing outlet 1119 and the valve 1122 can be a regulated dispenser that dispenses a mixture that includes an explosive and at least one thermally conductive material.

In the example of FIG. 11, the system 1100 can include a conveyor 1124 that transports capsules 1126 where chambers 1128 of the capsules 1126 may be filled with material dispensed via the dispensing outlet 1119.

As shown in the example of FIG. 11, the system 1100 can include a controller 1130 that includes one or more processors 1132, memory 1134 operatively coupled to at least one of the one or more processors 1132, instructions 1136 that can be, for example, stored in the memory 1134 and one or more interfaces 1138. As an example, the controller 1130 can include one or more processor-readable media that include processor-executable instructions executable by at least one of the one or more processors 1132 to cause the controller 1130 to control one or more aspects of the system 1100. In such an example, the memory 1134 can be or include the one or more processor-readable media where the processor-executable instructions can be or include the instructions 1136. As an example, a processor-readable medium can be a computer-readable storage medium that is not a signal and that is not a carrier wave.

In the example of FIG. 11, the method 1150 includes a dispense block 1152 for dispensing materials, a mix block 1154 for mixing materials, a sense block 1156 for sensing a thermal property and a dispense block 1158 for dispensing a mixture of the materials. As an example, the instructions 1136 can include instructions that correspond to one or more of the blocks 1152, 1154, 1156 and 1158 of the method 1150.

In the example of FIG. 11, the controller 1130 can receive signals from the sensor 1120 (e.g., via one or more of the interfaces 1138) and control one or more of the valves 1114 and/or the mixer 1118 and/or the valve 1122 and/or the conveyor 1124.

As an example, the sensor 1120 can sense information pertaining to thermal effusivity of the mixture and can optionally control composition of the mixture via control of one or more of the valves 1114. For example, the thermal effusivity of the mixture may be utilized as feedback in a control loop that controls one or more materials being dispensed into the bin 1116.

As an example, one of the feed lines 1112 can be a feed line for an explosive and one or more of the feed lines 1112 can be a feed line for one or more thermally conductive materials. In such an example, the materials (i.e., the explosive and the one or more thermally conductive materials) can be mixed in the bin 1116 where the composition of the resulting mixture in the bin 1116 depends on regulation of one or more of the valves 1114 as to one or more of the feed lines 1112.

As an example, the controller 1130 can be instructed to achieve one or more desired characteristics, which can be a thermal conductivity, as may be determined at least in part via information sensed by the sensor 1120, which may be a thermal effusivity sensor (e.g., as part of a sensor system). As an example, the sensor 1120 may provide information as to homogeneity or other characteristic of the mixture. As an example, the system 1100 can include a plurality of sensors. For example, thermal effusivity sensors may be located to sense thermal effusivity of material in a feed line or feed lines 1112, in the bin 1116, etc.

As an example, the controller 1130 can provide quantitative information germane to temperature rating of a mixture in a chamber of a capsule. For example, the instructions 1136 can include instructions to calculate a 1 hour rating temperature and a 100 hour rating temperature. As an example, such temperatures may be based at least in part on geometry of a chamber of a capsule and/or one or more dimensions of a chamber of a capsule.

As an example, the system 1100 of FIG. 11 can include a sealing unit that can at least partially seal a chamber of a capsule that includes a dispensed mixture. In such an example, a sealing unit may completely seal a chamber, optionally forming a hermetic seal.

As an example, a method may receive information as to a particular operation and environmental temperatures associated with the operation. For example, a temperature-time profile may be received and an amount and/or type of thermally conductivity material determined for inclusion in a mixture that includes explosive. Such a method can optionally include feedback controlling of the method based at least in part on one or more sensed thermal properties (e.g., thermal effusivity, etc.).

As an example, a system can include a mixer and/or blender with an in-line effusivity measurement sensor where at least a portion of sensed information can be utilized for metering an amount of thermally conductive material that can achieve a target powder goal (e.g., for a mixture to be dispensed into a chamber, etc.). As an example, a mixture can be dispensed into a chamber and pressed. For example, the system 1100 can include a press that can press the mixture as after it is dispensed into a chamber of a capsule.

As an example, a system may be utilized to form a batch mixture where the batch mixture is then transferred to a dispensing unit or dispensing units. As an example, a method can help to reduce variability of a mixture and can achieve one or more desired characteristics.

As an example, a capsule can include a shell that defines at least a portion of a chamber; and a mixture of an explosive and a thermally conductive material disposed in the chamber. In such an example, the thermally conductive material can be non-metallic. As an example, the thermally conductive material can include a metalloid.

As an example, a capsule can include a mixture of an explosive and a thermally conductive material disposed in a chamber where the thermally conductive material has a thermal conductivity in excess of 100 $W \cdot m^{-1} \cdot K^{-1}$.

As an example, a capsule can include a mixture of an explosive and a thermally conductive material disposed in a chamber where the thermally conductive material has a thermal conductivity in excess of 1,000 $W \cdot m^{-1} \cdot K^{-1}$.

As an example, a capsule can include a mixture of an explosive and a thermally conductive material disposed in a chamber where the thermally conductive material is or includes a carbon-based material such as, for example, one or more of graphene and diamond (e.g., natural and/or synthetic).

As an example, a capsule can include a mixture of an explosive and a thermally conductive material disposed in a chamber where the thermally conductive material is or includes boron nitride.

As an example, a capsule can include a mixture of an explosive and a thermally conductive material disposed in a chamber where the thermally conductive material is or includes boron arsenide, which can be or include cubic boron arsenide.

As an example, a capsule can include a mixture of an explosive and a thermally conductive material disposed in a chamber where the thermally conductive material is or includes boron and carbon.

As an example, a capsule can include a mixture of an explosive and a thermally conductive material disposed in a chamber where the mixture is at least approximately 0.1 percent of the thermally conductive material by mass.

As an example, a capsule can include a mixture of an explosive and a thermally conductive material disposed in a chamber where the chamber is a booster chamber that has a volume of at least approximately 0.5 $cm^3$.

As an example, a capsule can include a mixture of an explosive and a thermally conductive material disposed in a chamber where the chamber has a volume of at least approximately 2 $cm^3$.

As an example, a method can include forming a mixture of an explosive and a thermally conductive material; disposing at least a portion of the mixture in a chamber of a capsule; and at least partially sealing the chamber. In such an example, the sealing may completely seal the chamber. As an example, the sealing may hermetically seal the chamber. As an example, a seal may be formed by contact between two different components of the capsule. In such an example, the two different components may be made of different materials. As an example, a seal may be formed at least in part by fitting a liner to a shell.

As an example, a capsule can include a shell where a chamber defined at least in part by the shell is at least partially sealed via a liner that is fit to the shell. For example, a method can include at least partially sealing a chamber of a capsule by fitting a liner to a shell.

As an example, a method can include disposing a capsule in a perforating gun. In such an example, the method can include disposing the perforating gun in a bore in a geologic environment. In such an example, the method can include heating the capsule to a temperature greater than approximately 120 degrees C. In such an example, the method can include decomposing at least a portion of explosive in the capsule at a site in a chamber of the capsule via an autocatalytic reaction that generates heat energy and conducting at least a portion of the heat energy away from the site. In such an example, the explosive can be a mixture that includes thermally conductive material that conducts at least a portion of the heat energy away from the site.

As an example, a method can include forming a mixture of an explosive and a thermally conductive material; disposing at least a portion of the mixture in a chamber of a capsule; and at least partially sealing the chamber. In such an example, the method can include sensing thermal effusivity of the mixture and controlling the forming based at least in part on the sensing. For example, one or more dispenser may be controlled based at least in part on sensing of thermal effusitivty (e.g., one or more values of thermal effusivity, proxies for thermal effusivity, etc.).

As an example, a system can include a regulated dispenser that dispenses a thermally conductive material; a regulated dispenser that dispenses an explosive; a bin that holds a mixture of the explosive as dispensed and the thermally conductive material as dispensed; a sensor that senses a thermal property of the mixture; and a controller that controls at least one of the regulated dispensers based at least in part on the thermal property of the mixture. In such an example, the thermal property can be thermal effusivity.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 12:
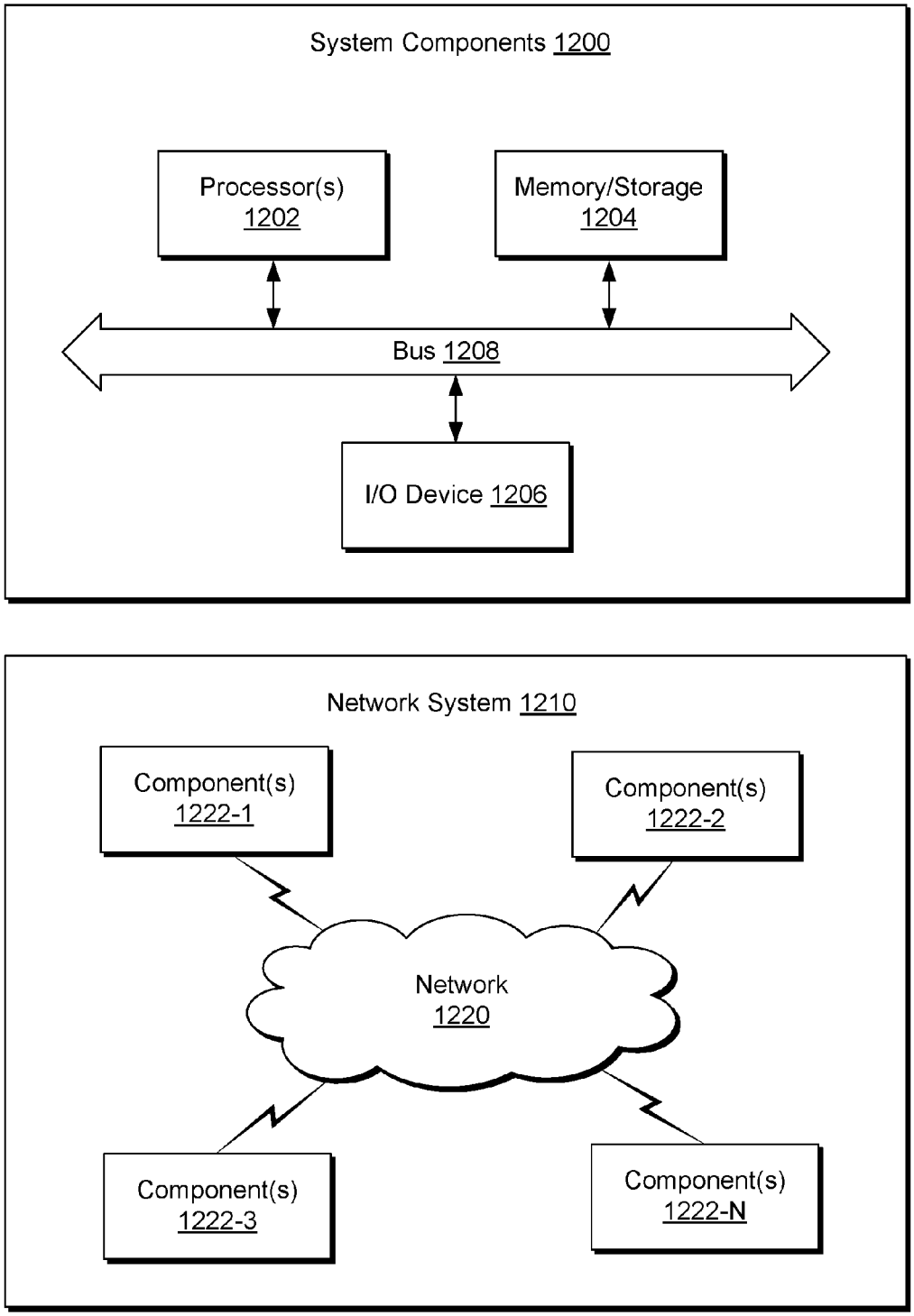
FIG. 12 illustrates example components of a system and a networked system.

FIG. 12 shows components of a computing system 1200 and a networked system 1210. The system 1200 includes one or more processors 1202, memory and/or storage components 1204, one or more input and/or output devices 1206 and a bus 1208. According to an embodiment, instructions may be stored in one or more computer-readable media (e.g., memory/storage components 1204). Such instructions may be read by one or more processors (e.g., the processor(s) 1202) via a communication bus (e.g., the bus 1208), which may be wired or wireless. As an example, instructions may be stored as one or more modules. As an example, one or more processors may execute instructions to implement (wholly or in part) one or more attributes (e.g., as part of a method). A user may view output from and interact with a process via an I/O device (e.g., the device 1206). According to an embodiment, a computer-readable medium may be a storage component such as a physical memory storage device, for example, a chip, a chip on a package, a memory card, etc.

According to an embodiment, components may be distributed, such as in the network system 1210. The network system 1210 includes components 1222-1, 1222-2, 1222-3, . . . , 1222-N. For example, the components 1222-1 may include the processor(s) 1202 while the component(s) 1222-3 may include memory accessible by the processor(s) 1202. Further, the component(s) 1202-2 may include an I/O device for display and optionally interaction with a method. The network may be or include the Internet, an intranet, a cellular network, a satellite network, etc.

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A capsule comprising:

a shell that defines at least a portion of a chamber; and a mixture of an explosive and a thermally conductive material disposed in the chamber, wherein said thermally conductive material comprises one or more layers of graphene having at least one polymer bonded thereto.

2. The capsule of claim 1 wherein the thermally conductive material is coated on crystals of the explosive.

3. The capsule of claim 1 wherein the thermally conductive material comprises a thermal conductivity in excess of 100 $W \cdot m^{-1} \cdot K^{-1}$.

4. The capsule of claim 1 wherein the thermally conductive material comprises a thermal conductivity in excess of 1000 $W \cdot m^{-1} \cdot K^{-1}$.

5. The capsule of claim 1 wherein the mixture comprises at least approximately 0.1 percent of the thermally conductive material by mass.

6. The capsule of claim 1 wherein the chamber comprises a booster chamber that comprises a volume of at least approximately 0.5 $cm^3$.

7. The capsule of claim 1 wherein the chamber comprises a volume of at least approximately 2 $cm^3$.

* * * * *